US007110430B2

(12) United States Patent
Lazor

(10) Patent No.: US 7,110,430 B2
(45) Date of Patent: Sep. 19, 2006

(54) INDUCTION FURNACE FOR MELTING SEMI-CONDUCTOR MATERIALS

(75) Inventor: David A. Lazor, Hubbard, OH (US)

(73) Assignee: Ajax Tocco Magnethermic Corporation, Euclid, OH (US)

( * ) Notice: Subject to any disclaimer, the term of this patent is extended or adjusted under 35 U.S.C. 154(b) by 0 days.

(21) Appl. No.: 10/851,567

(22) Filed: May 21, 2004

(65) Prior Publication Data

US 2005/0259712 A1 Nov. 24, 2005

(51) Int. Cl.
*H05B 6/44* (2006.01)

(52) U.S. Cl. ..... 373/144; 373/149

(58) Field of Classification Search ..... 373/5–7, 373/59, 138–142, 144, 146, 149, 151, 152, 373/156, 157, 159, 18; 219/634, 651; 65/17.6, 65/144, 335

See application file for complete search history.

(56) References Cited

U.S. PATENT DOCUMENTS 1,655,983 A * 1/1928 Brace ..... 373/159
3,696,223 A * 10/1972 Metcalf et al. ..... 373/157
4,915,723 A * 4/1990 Kaneko et al. ..... 65/335
5,502,743 A * 3/1996 Conochie et al. ..... 373/151
5,781,581 A 7/1998 Fishman
6,361,597 B1 3/2002 Takase et al.

* cited by examiner

*Primary Examiner*—Tu Hoang
(74) *Attorney, Agent, or Firm*—Sand & Sebolt

(57) ABSTRACT

An induction furnace includes an induction coil, an electrically non-conductive crucible having an inner diameter disposed within the induction coil, and an electrically conductive member disposed below the crucible and having an outer diameter which is further from the induction coil than is the inner diameter of the crucible. Due to the non-conductive nature of material disposed within the crucible at lower temperatures, the induction coil initially inductively heats the conductive member, which transfers heat to the material to melt a portion of the material. Once the material is susceptible to inductive heating (usually upon melting) the susceptible material is inductively heated by the induction coil. During the process, inductive heating of the material greatly increases as inductive heating of the conductive member greatly decreases due to low resistivity of the molten material and due to the molten material being closer to the coil than is the conductive member.

38 Claims, 14 Drawing Sheets

INDUCTION FURNACE FOR MELTING SEMI-CONDUCTOR MATERIALS

BACKGROUND OF THE INVENTION

1. Technical Field

The invention relates to induction heating and an improved induction furnace. More particularly, the invention relates to an induction furnace for melting materials not susceptible to inductive heating at lower temperatures but which are susceptible to inductive heating at higher temperatures, especially upon melting. Specifically, the invention relates to an induction furnace having an electrically conductive susceptor disk which is inductively heated whereby heat is transferred from the disk to such materials to make them susceptible to inductive heating whereby the materials are then inductively heated to melt them.

2. Background Information

Induction furnaces are well known in the art. However, there are a variety of difficulties related to the inductive heating and melting of materials that are initially non-conductive or which have particle sizes sufficiently small so that they are not susceptible to inductive heating. Many prior art induction furnaces utilize a conductive crucible such that an induction coil couples with the crucible to transfer energy directly to the crucible to heat the crucible. Heat is then transferred from the crucible to the material to be melted via thermal conduction. In certain cases, the induction frequency and the thickness of the crucible wall may be selected so that a portion of the electromagnetic field from the coil allows coupling with any electrically conductive material inside the crucible to inductively heat the material directly. However, the direct inductive heating in such cases is quite limited. Because direct inductive heating of the material to be melted is far more effective than the method described above, a system to effect such direct inductive heating is highly desirable.

In addition, the conductive crucibles of the prior art may react with the material to be melted which causes unwanted impurities in the melt and thus requires the use of a non-reactive liner inside the crucible to prevent formation of such impurities. Typically, such liners are electrically non-conductive and thermally insulating. As a result, the transfer of heat from the crucible to the materials to be melted is greatly impeded, thus substantially increasing melting times. To expedite the transfer of heat from the crucible to the material to be melted, the crucible must be heated to undesirably high temperatures which can decrease the life of the crucible and liner.

In addition, there remains a need for an induction furnace capable of producing a continuous melt in an efficient manner, especially for semi-conductor materials. An efficient continuous melt induction furnace is particularly useful for continuous formation of semi-conductor crystals, which are highly valued in the production of computer chips.

U.S. Pat. No. 6,361,597 to Takase et al. teaches three embodiments of an induction furnace especially intended for melting semi-conductor materials and adapted to supply the molten material to a main crucible for pulling of semi-conductor crystals therefrom. Unlike the prior art discussed above, Takase et al. uses a quartz crucible which is electrically non-conductive along with a susceptor which is in the form of a carbon or graphite cylinder. In each of the three embodiments of Takase et al., the carbon or graphite cylinder susceptor is initially inductively heated by a high frequency coil whereby heat is transferred from the susceptor to raw material inside the crucible in order to begin the melting process. Once the raw material is melted, it is directly inductively heated by the high frequency coil in order to speed up the melting process. While this is a substantial improvement over the previously discussed prior art, the induction furnace of Takase et al. still leaves room for improvement, as discussed below.

The first embodiment of Takase et al. involves the use of a pipe extending upwardly into the quartz crucible whereby the pipe receives molten material from within the crucible by overflow and transmits it to a main crucible from which semi-conductor crystals are pulled. The carbon cylinder susceptor encircles the quartz crucible and is moveable in a vertical direction. Prior to melting the material in the crucible, the carbon cylinder is positioned so it covers the entire side wall of the crucible. Once some of the material is melted, the carbon cylinder is moved upwardly so that the molten material is inductively heated by the coil. Once the raw material is fully melted, additional raw material is added and the carbon cylinder is moved downwardly to cover the upper half of the side wall of the crucible so that the carbon cylinder is inductively heated and transfers heat therefrom to aid in melting the added raw material.

While the first embodiment of Takase et al. permits the susceptor to be substantially removed from the electromagnetic field of the induction coil so that it is not further inductively heated or so that the inductive heat is minimized therein, this process still has some disadvantages. One disadvantage to this configuration is the need to provide a mechanism to move the cylindrical susceptor upwardly and downwardly. Another disadvantage of the configuration is the need for a mechanism to monitor the melt in order to determine the proper time to move the susceptor away from the crucible side wall. Because direct inductive heating of the molten materials is more effective than inductive heating of the susceptor and subsequent transfer of heat from the susceptor to the material, any time that the susceptor is left in place after the molten material is susceptible to inductive heating, it prevents the more efficient direct inductive heating of the melt.

The second embodiment in Takase is similar to the first embodiment except that the pipe for transferring molten material from the quartz crucible to the main crucible does not extend upwardly into the quartz crucible. A mass of the initial raw material is disposed over the opening of the pipe and effectively serves as a stopper until the stopper portion is itself melted. In order to prevent the stopper from being melted too soon, the carbon cylinder initially only covers about two thirds of the upper portion of the side wall of the crucible so that heat transferred from the carbon cylinder is transmitted only to about the upper two thirds of the raw material. As the raw material is melted, the carbon cylinder is moved downward to cover the entire side wall of the crucible. Then the carbon cylinder is moved upwardly to cover the upper half of the side wall of the crucible whereby continued inductive heating of the carbon cylinder allows heat transfer from the carbon cylinder to raw material that is added to the melt. Induction heat is also generated in the melt at this point.

The second embodiment similarly suffers from the need for moving the cylindrical susceptor in a vertical fashion. The process must also be monitored in order to determine when to move the susceptor cylinder downwardly to maintain a reasonably high efficiency. Further, the susceptor interferes with the inductive heating of the molten material when positioned around the crucible while there is still unmelted raw material within the crucible.

In the third embodiment, Takase et al. provides a pipe which extends upwardly into the crucible as in the first embodiment to provide overflow of the molten material to the main crucible. In this embodiment, the susceptor has a crucible-like configuration whereby the susceptor cylindrical portion covers the sidewall of the quartz crucible and the bottom of the susceptor covers the lower surface of the quartz crucible. In this embodiment, the susceptor is not vertically moveable. Instead, the thickness of the susceptor sidewall and the frequency applied by the coil are selected so that the penetration depth of the induction current will extend beyond the susceptor into the quartz crucible so that it can inductively heat material inside. As with the prior embodiments, the susceptor is inductively heated and then transfers heat to the raw material to begin the melting process. Once the melting process has begun, inductive heating of the melt also occurs and the melt continues as a result of both inductive heating directly of the molten material as well as transferred heat from the inductively heated susceptor. In addition, the frequency applied to the coil is preferably initially at a relatively high frequency and then once the melting has begun is shifted to a relatively low frequency to better focus inductive heating of the molten portion of the material.

This third embodiment primarily suffers from the fact that the cylindrical susceptor remains in place and thus prevents inductive heating from being focused more effectively on the raw material within the crucible. Instead, the coil continues to inductively heat the carbon cylinder so that energy which might be applied to the material is absorbed by the carbon cylinder, which transfers heat to the raw material in the crucible in a far less effective manner.

BRIEF SUMMARY OF THE INVENTION

The present invention provides an induction furnace comprising an electrically non-conductive crucible defining a melting cavity; an electrically conductive member disposed adjacent the crucible; an induction member for inductively heating material within the melting cavity; and a portion of the melting cavity being closer to the induction member than is the conductive member.

The present invention also provides an induction furnace for melting material, the furnace comprising an electrically non-conductive crucible defining a melting cavity; an electrically conductive member disposed adjacent the crucible in a fixed relation with respect to the crucible; an induction member for creating an electromagnetic field to inductively heat material within the melting cavity and to inductively heat the conductive member; each of the conductive member and the material within the melting cavity absorbing energy from the electromagnetic field whereby the conductive member and material together absorb a combined energy from the electromagnetic field; the crucible, conductive member and induction member being positioned with respect to each other so that inductive heating via the induction member occurs initially within the conductive member and occurs in the material within the melting cavity when the conductive member has transferred sufficient heat to the material to make the material susceptible to inductive heating so that at a certain time during inductive heating the conductive member absorbs no more than thirty percent of the combined energy absorbed by the conductive member and material.

The present invention further provides an induction furnace for melting material, the furnace comprising an induction member for creating an electromagnetic field; an electrically non-conductive crucible defining a melting cavity containing the material to be melted; the material absorbing over time a varying amount of energy created by the magnetic field; an electrically conductive member disposed adjacent the crucible in a fixed relation with respect to the crucible; the conductive member absorbing over time a varying amount of energy created by the magnetic field; and the crucible, conductive member and induction member being positioned with respect to each other so that during heating and melting of the material the amount of energy from the electromagnetic field absorbed by the conductive member to create inductive heating therein is substantially inversely proportional to the amount of energy from the electromagnetic field absorbed by the material in the melting cavity to create inductive heating therein.

The present invention also provides a method of heating comprising the steps of placing material within a melting cavity of an electrically non-conductive crucible; positioning an electrically conductive member and an induction member so that a portion of the melting cavity is closer to the induction member than is the conductive member; heating the conductive member inductively with the induction member; transferring heat from the conductive member to the material; and heating a portion of the material inductively with the induction member.

The present invention also provides a method of heating a material comprising the steps of placing a material within a melting cavity of an electrically non-conductive crucible; positioning a conductive member and an induction member so that a portion of the melting cavity is closer to the induction member than is the conductive member; heating the conductive member resistively; transferring heat from the conductive member to the material; and heating a portion of the material inductively with the induction member.

DETAILED DESCRIPTION OF THE INVENTION

Figure 1:
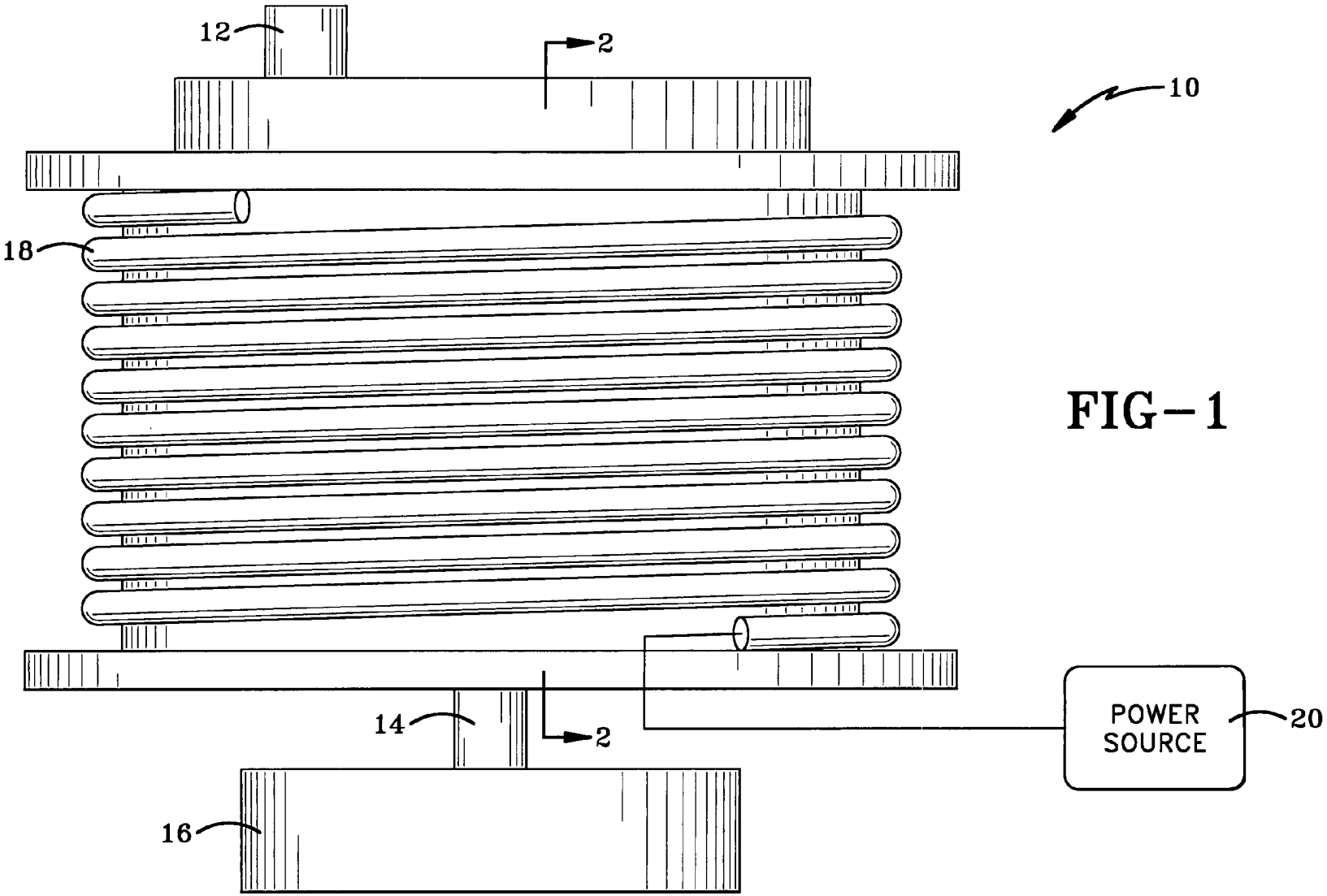
FIG. 1 is a side elevational view of a first embodiment of the induction furnace of the present invention in an environment adapted for continuous melting and crystal formation.
Figure 2:
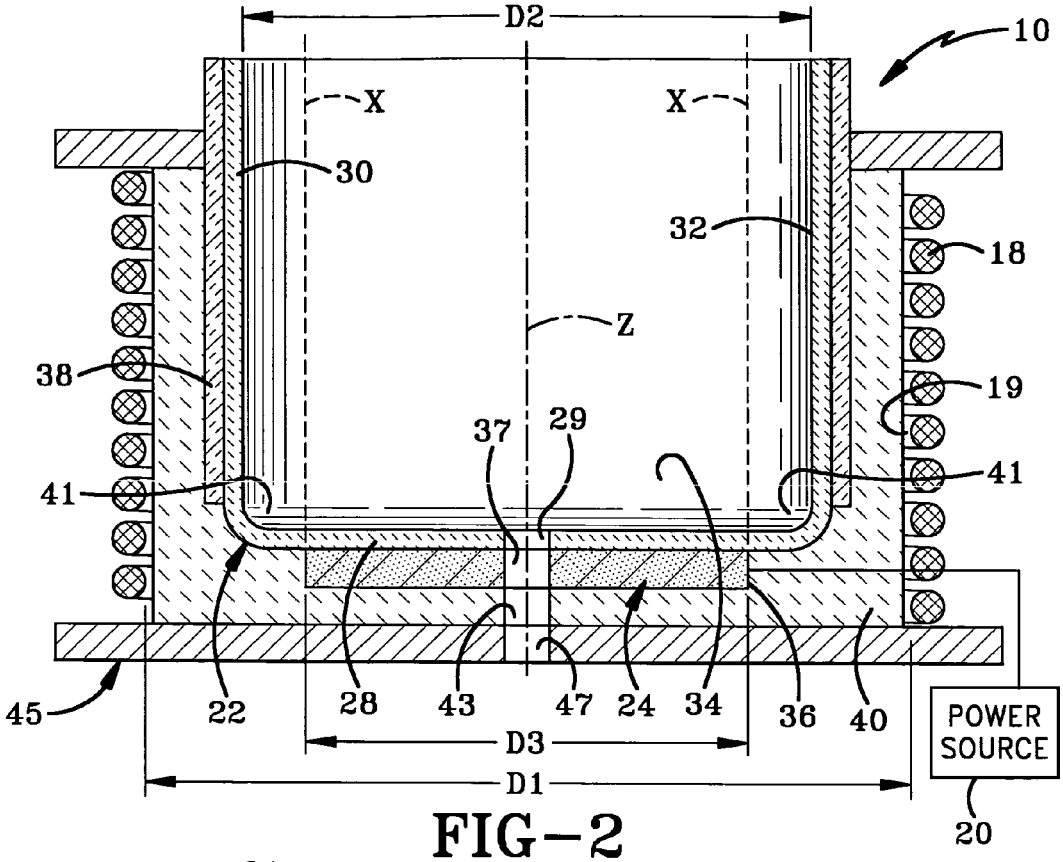
FIG. 2 is a sectional view taken on line 2—2 of FIG. 1 wherein the crucible is empty.
Figure 17:
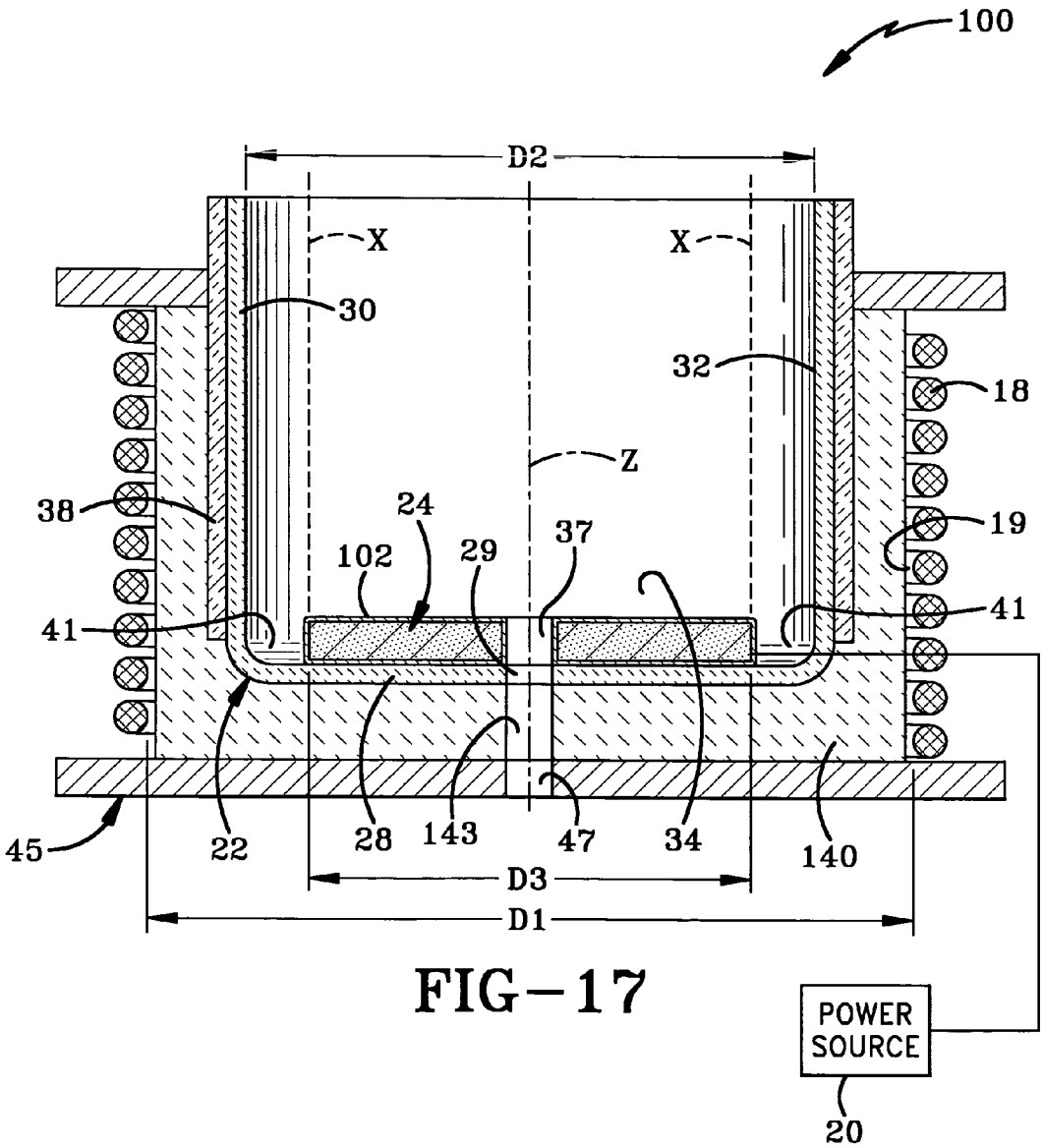
FIG. 17 is sectional view similar to FIG. 2 of a second embodiment of the induction furnace of the present invention showing the susceptor within the melting cavity of the crucible.

A first embodiment of the induction furnace of the present invention is indicated generally at 10 in FIGS. 1–2, and a second embodiment is indicated generally at 100 in FIG. 17. Furnaces 10 and 100 are configured to melt material which is electrically non-conductive at relatively lower temperatures and electrically conductive at relatively higher temperatures or upon melting, such as semi-conductor materials, or to melt material having particle sizes sufficiently small so that they are not susceptible to inductive heating even if of an electrically conductive material. The invention is particularly useful for melting semi-conductor materials and while reference may be made to semi-conductor materials in the application, this should not be deemed to limit the scope of the invention. Furnaces 10 and 100 may also be used with fibrous materials or other materials having geometries which are particularly difficult to melt via inductive heating. Heating liquids is also an option, as detailed further below. While the invention is thus widely applicable, the exemplary embodiment describes the heating and melting of solid material in particulate form.

Furnace 10 is shown in FIG. 1 in an environment for continuous or intermittent melting and production of semiconductor crystals wherein furnace 10 is adapted to utilize a feed mechanism 12, a transfer or pouring mechanism 14 and a receiving crucible or tundish 16 for receiving molten material from furnace 10 via pouring mechanism 14.

Figure 3:
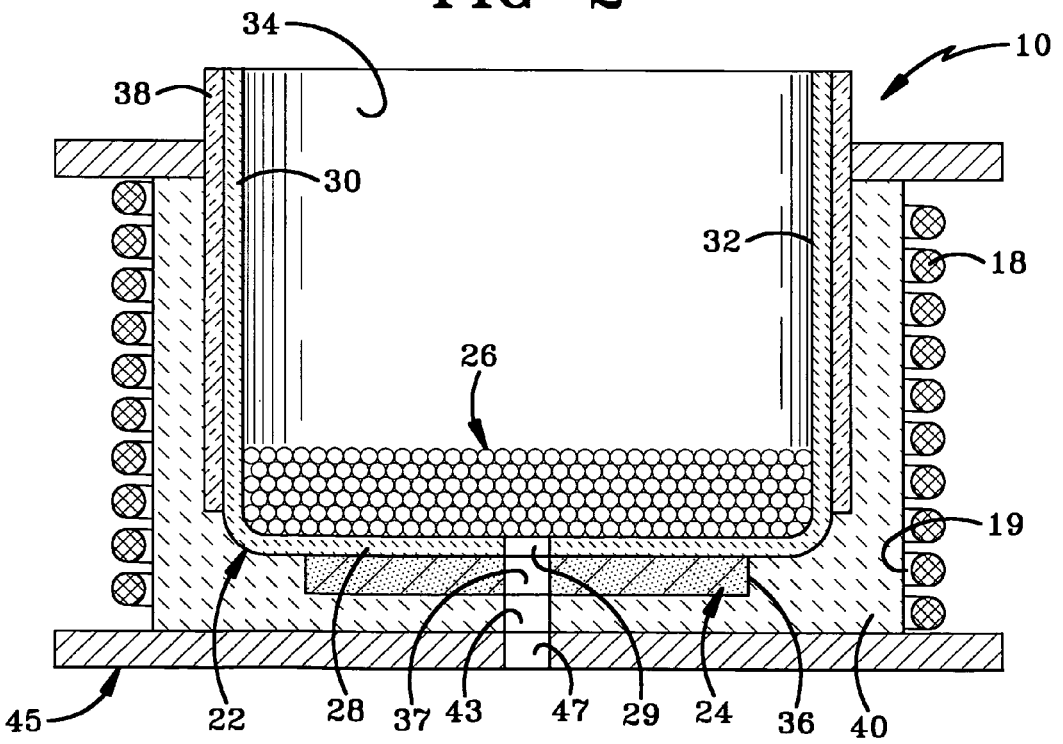
FIG. 3 is a sectional view similar to FIG. 2 except the crucible contains solid material to be melted.

With reference to FIGS. 1–3, furnace 10 includes an induction member or induction coil 18 connected to a power source 20. Coil 18 is substantially cylindrical although it may taken a variety of shapes. Coil 18 defines an interior space 19 and has an interior diameter D1 as shown in FIG. 2. Furnace 10 also includes a crucible 22 and an electrically conductive member referred to in the induction heating industry as a susceptor 24. Furnace 10 is configured so that electrical current passing through coil 18 creates an electromagnetic field which couples initially with susceptor 24 to inductively heat susceptor 24 and thereby transfers heat by conduction and radiation from susceptor 24 to unmelted raw material 26 (FIG. 3) in order to melt a portion of raw material 26. Furnace 10 is further configured so that the portion of material 26 which is molten is inductively heated by coil 18 so that the inductive heating of molten material 26 far exceeds the inductive heating of susceptor 24.

Crucible 22 includes a bottom wall 28 and a cylindrical sidewall 30 extending upwardly therefrom. Bottom wall defines an exit opening 29. Sidewall 30 has an inner surface 32 defining an inner diameter D2, as shown in FIG. 2. Bottom wall 28 and sidewall 30 define a melting cavity 34 there within. Crucible 22 is formed of an electrically non-conductive material. While a variety of materials may be suitable for different applications, quartz is usually preferred for use with melting of semi-conductor materials, especially silicon.

Susceptor 24 may take a variety of shapes, but preferably is in the form of a cylindrical disk having an outer perimeter 36 and defining a hole 37. Outer perimeter 36 defines an outer diameter D3 (FIG. 2) which is smaller than diameter D2 of crucible 22. Susceptor 24 is formed of an electrically conductive material suitable for inductive heating, such as graphite. Susceptor 24 is disposed below crucible 22 closely adjacent bottom wall 28 and preferably in abutment therewith. An insulator 38 encircles sidewall 30 of crucible 22 and a refractory material 40 surrounds a substantial portion of crucible 22 and is seated on a support 45. Material 40 defines a hole 43 and support 45 defines a hole 47. Exit opening 29 of crucible 22 and holes 37, 43, and 45 are aligned to allow molten material to flow via pouring mechanism 14 into tundish 16.

Alternately, susceptor 24 may be replace with one or more heating elements connected to power source 20 (FIG. 2). Thus, the heating elements may be resistively heated via an electrical current from power source 20. In addition, these resistive heating elements may be inductively heated by induction coil 18. As a result, the conductive member may be heated by induction, by resistance or both, depending on the material used and the configuration thereof.

In accordance with one of the main features of the invention, outer perimeter 36 of susceptor 24 is further away from coil 18 than is inner surface 32 of crucible 22 sidewall 30 as shown by the difference of diameters D1, D2 and D3 in FIG. 2. More particularly, some of the space within melting cavity 34 is closer to coil 18 than is susceptor 24 so that a portion of molten material may be disposed within said space, indicated at 41 in FIG. 2, and thus be closer to coil 18 than is susceptor 24. Space 41 is disposed between inner surface 32 of sidewall 30 and an imaginary cylinder defined by lines X (FIG. 2) extending upwardly from outer perimeter 36 of susceptor 24. Preferably, coil 18, inner surface of sidewall 30 and outer perimeter 36 of susceptor 24 are all concentric about an axis Z (FIG. 2).

In operation, and with reference to FIGS. 2–8, furnace 10 functions as follows. FIG. 2 shows furnace 10 prior to being charged with raw material 26. FIG. 3 shows an initial charge of raw material 26 having been placed into melting cavity 34 of crucible 22. While a greater amount of material 26 may be placed initially in crucible 22, additional material 26 hinders the initial melting process by dispersing heat over a greater amount of material. Once material 26 has been added to crucible 22, electrical power is provided from power source 20 to coil 18 to create an electromagnetic field around coil 18 which flows in the direction of Arrows A in FIGS. 4–8. Prior to the melting of any of material 26, the electromagnetic field from induction coil 18 produces induction heating within susceptor 24. In the initial phase, material 26 is not susceptible to inductive heating. As previously noted, this may be because material 26 is not electrically conductive at a relatively low temperature, or it may be because material 26 is of sufficiently small particles to prevent the flow of electrical current as a result of the small contact area between particles, or both. Once susceptor 24 is inductively heated, susceptor 24 transfers heat by conduction and/or radiation through crucible 22 in order to melt a portion of material 26, a molten portion 42 being shown in FIGS. 4–7.

Alternately, where conductive member (24) is one or more resistive heating elements, power source 20 provides electrical power to resistively heat the heating elements, which in turn transfer heat conductively and radiantly in the same manner as described above with regard to susceptor 24 after being inductively heated. If desired, the heating elements may also be simultaneously inductively heated by induction coil 18. Whether heated only resistively or in combination with inductive heating, a portion of material 26 is thus heated and melted. Where only resistive heating is used to melt the initial portion of material 26 so that it becomes inductively heatable, power to the heating elements for heating by resistance is then halted and induction coil 18 is powered to inductively heat the susceptible portion of material 26, as described below. The operation with respect to the use of susceptor 24 below is essentially the same for the use of resistive heating elements, although there may be some variations within the scope of the inventive concept. For instance, the configuration of the heating elements may lend themselves to inductive heating to a greater or lesser degree, and thus a certain configuration may act very similarly to susceptor 24 with regard to the inductive heating of the heating elements whereas another configuration may not be nearly as susceptible to inductive heating. To the extent that the heating elements are inductively heatable, the concepts discussed below regarding the inductive heating aspects of susceptor 24 also hold true for such heating elements.

Figure 4:
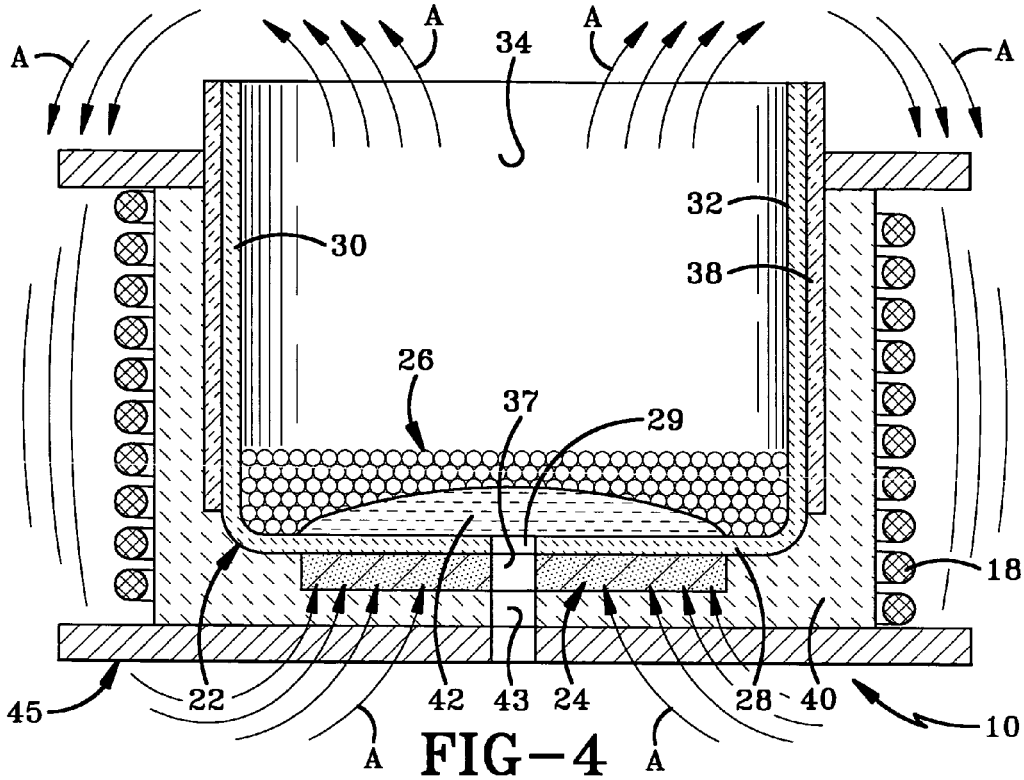
FIG. 4 is similar to FIG. 3 and shows a stage wherein a portion of the material is melted with arrows representing an electromagnetic field.
Figure 5:
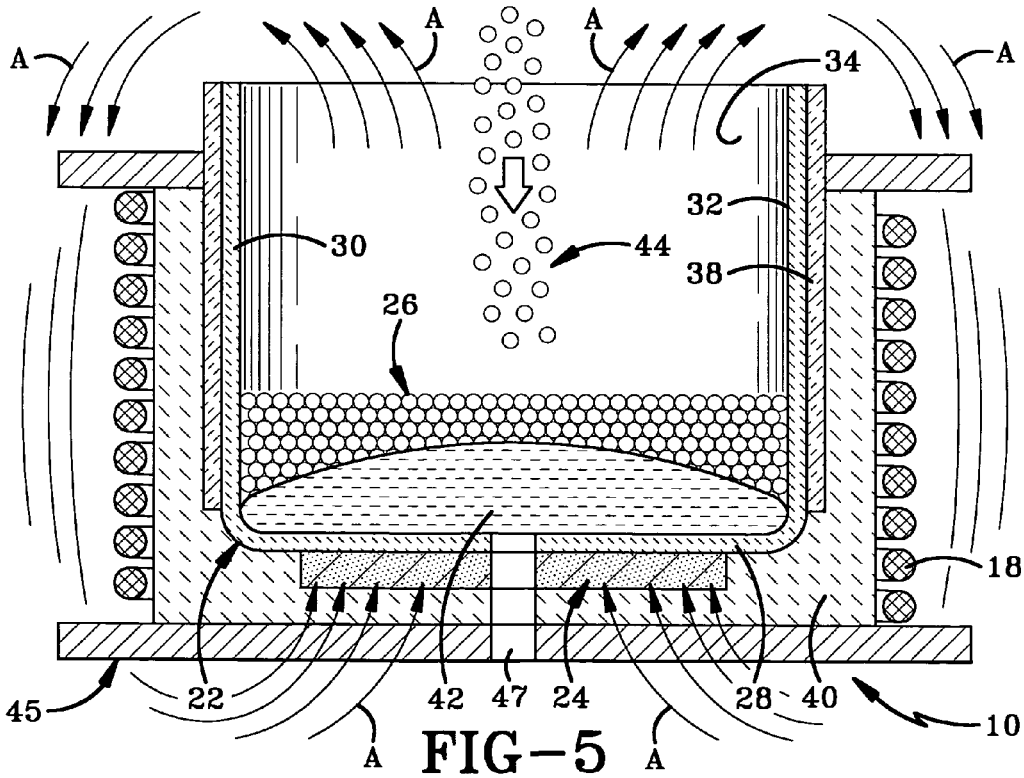
FIG. 5 is similar to FIG. 4 and shows a further stage of melting and additional material being added to the crucible.

Molten portion 42 is electrically conductive and is susceptible to inductive heating by coil 18. Thus, coil 18 begins to inductively heat molten portion 42 while simultaneously inductively heating susceptor 24. In general, as the molten portion within crucible 22 grows, inductive heating of the molten portion increases and inductive heating of susceptor 24 decreases. FIG. 4 shows molten portion 42 having an outer perimeter which extends laterally outwardly to approximately the same distance as outer perimeter 36 of susceptor 24. At this point, inductive heating of molten portion 42 is occurring, but is not as pronounced as in FIG. 5 where the molten portion has extended outwardly to inner surface 32 of crucible side wall 30. At the stage shown in FIG. 5, inductive heating of molten portion is substantially increased due to the molten portion extending closer to coil 18 than does outer perimeter 36 of susceptor 24. As a result, inductive heating of susceptor 24 is decreasing as the inductive heating of the molten material is increasing. FIG. 5 also shows additional material 44 being added to melting cavity 34. The addition of such material may occur while there is still unmelted material in the crucible or once all the material is molten.

Figure 6:
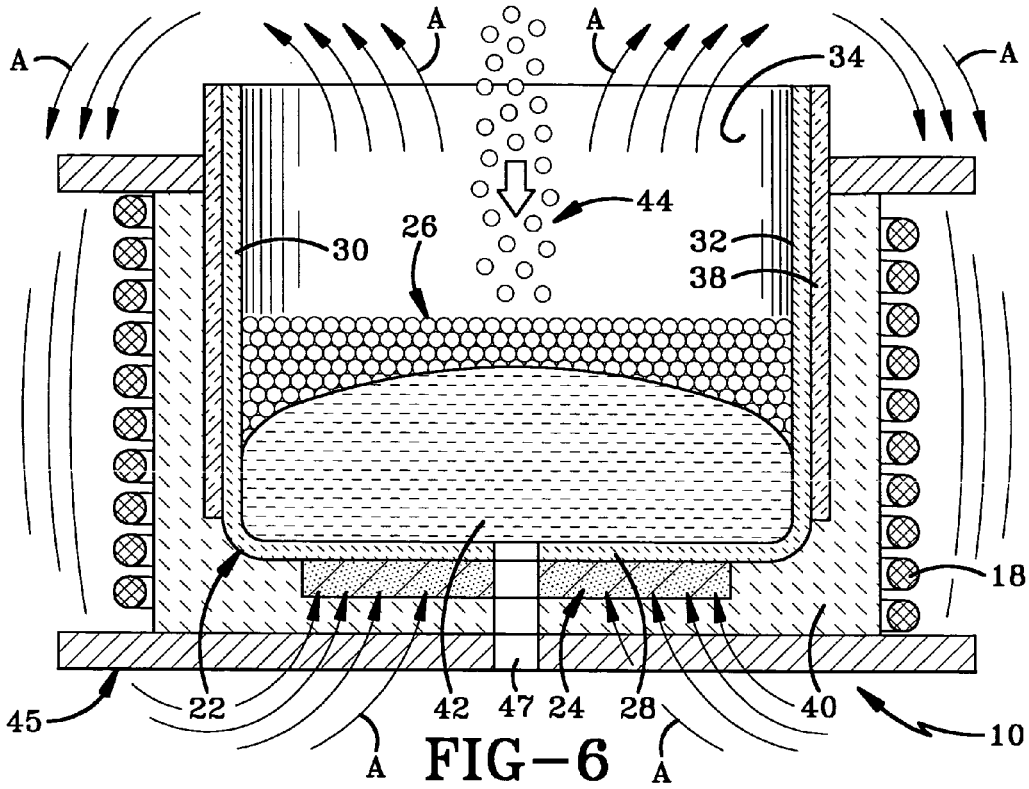
FIG. 6 is similar to FIG. 5 and shows a further stage of melting and additional material being added to the crucible.
Figure 7:
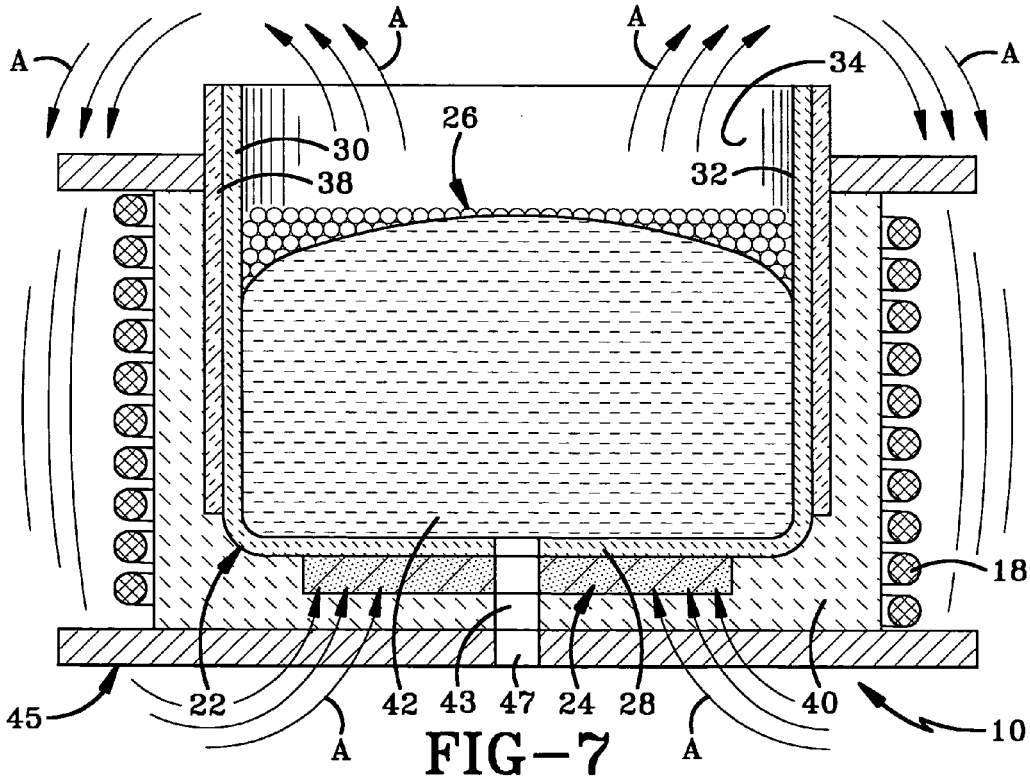
FIG. 7 is similar to FIG. 6 and shows a still further stage wherein nearly all the material is molten.
Figure 8:
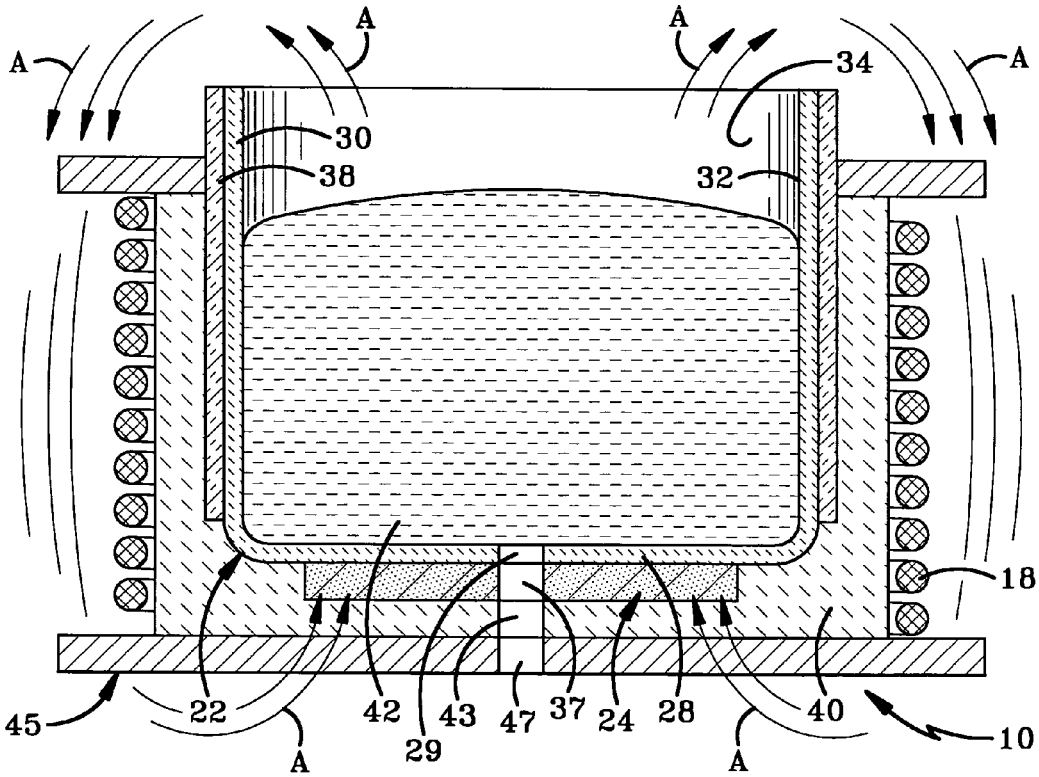
FIG. 8 is similar to FIG. 7 and shows all the material in the crucible is molten.

FIG. 6 shows a further stage of melting wherein the inductive heating continues to increase within the molten material and decrease within susceptor 24. Additional material 44 is also being added in FIG. 6. FIG. 7 shows raw material 26 almost fully melted and at a stage where the inductive heating of susceptor 24 is minimal and most of the inductive heating is occurring within the molten material. FIG. 8 shows all the raw material 26 having been melted and at a stage where the inductive heating of susceptor 24 is quite minimal.

Figure 9:
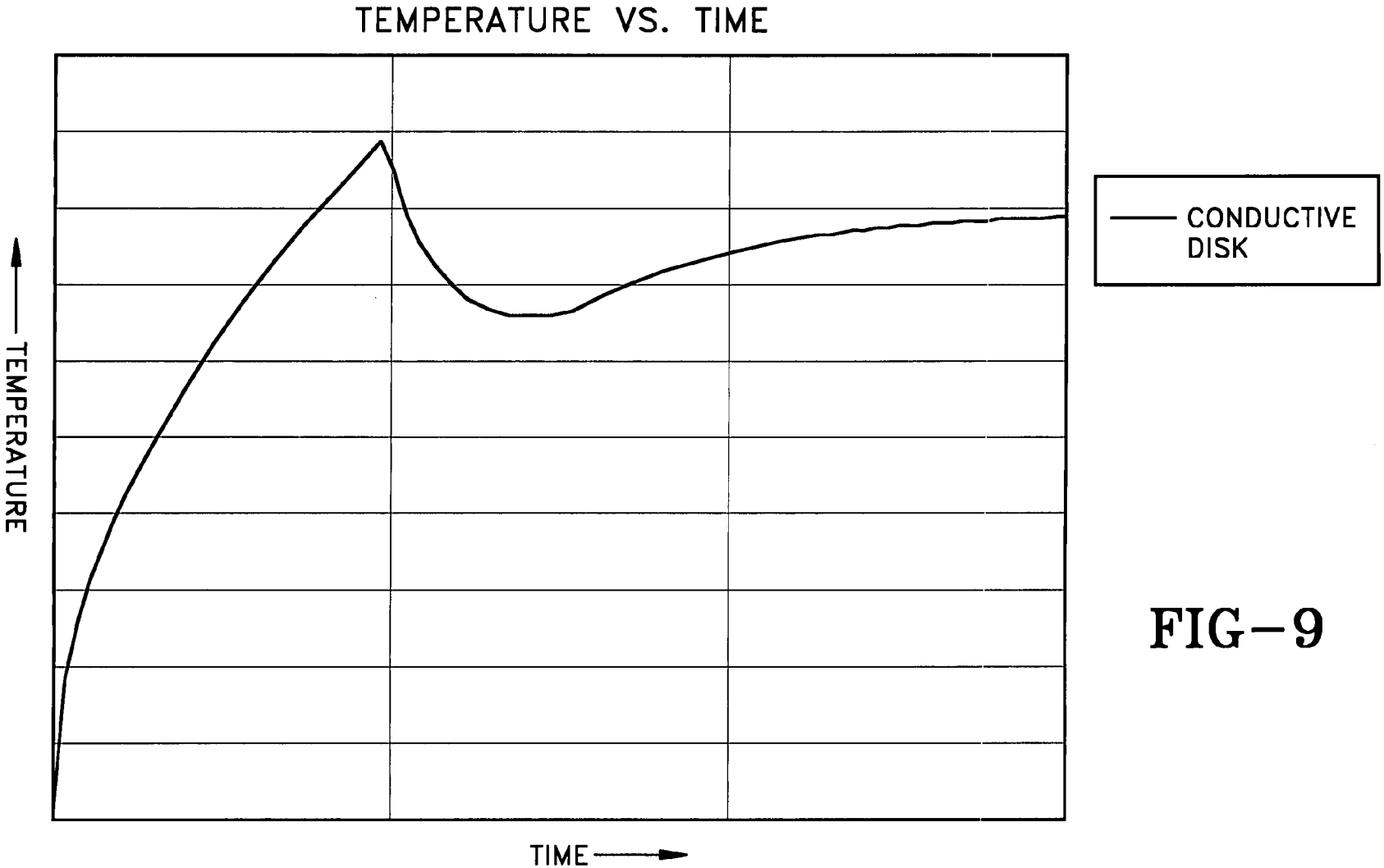
FIG. 9 is a graph showing the temperature of the conductive disk during the melting process.

In the earlier stages of the heating/melting process, heat was being transferred by conduction and radiation from susceptor 24 into raw materials 26 via crucible 22. However, a reversal occurs wherein the inductive heating of susceptor 24 is sufficiently reduced and the inductive heating of molten material 42 sufficiently increased so that heat from molten material 42 in crucible 22 is being transferred through crucible 22 into susceptor 24. This is illustrated in part in FIG. 9, which shows the temperature of susceptor 24 over time. Susceptor 24 is referred to in FIGS. 9–10 as "conductive disk". The graph of FIG. 9 illustrates that the temperature of the conductive disk increases relatively steeply until it reaches a peak and then drops off fairly substantially and then gradually increases. The sharp increase in the temperature of the disk is related to the inductive heating thereof which peaks about the point when materials within the crucible begin to melt and become inductively heatable by the coil. As direct inductive heating of the raw material increases and inductive heating of the susceptor or conductive disk drops off rather sharply, the temperature likewise drops a fairly substantial amount. Then, once the molten material increases in heat and volume, the heat within the molten material is transferred by conduction and radiation back through crucible 22 to the conductive disk, thereby heating it back up gradually to a certain level. This latter increase in heat is due almost entirely to the transfer of heat from the molten material, as inductive heating of the conductive disk becomes fairly minimal once the material is fully molten or fairly shortly before the fully molten stage.

Figure 10:
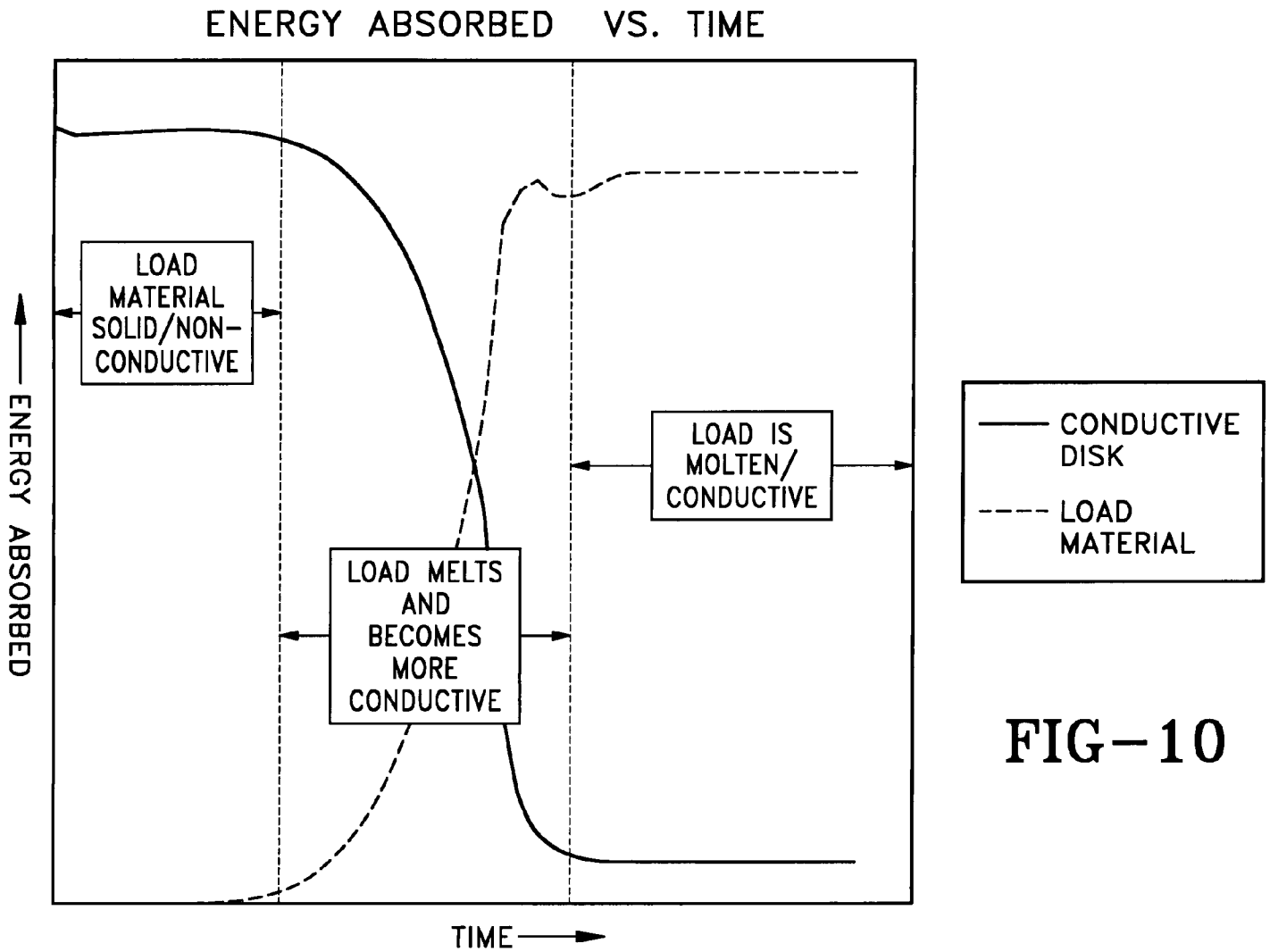
FIG. 10 is a graph showing energy consumed overtime by the conductive disk and the material to be melted.

FIG. 10 shows the energy absorbed from the electromagnetic field induction coil 18 by both the conductive disk and the load material or raw mater to be melted during the melting process. More particularly, FIG. 10 shows the energy absorbed by the disk from the electromagnetic field which is transferred by direct inductive coupling of the disk with coil 18 and the energy absorbed by the load material from the electromagnetic field which is transferred by direct inductive coupling of the load material with coil 18. Such energy is hereinafter "direct inductive heating energy". As clearly illustrated, the conductive disk absorbs essentially all of the energy that is going toward inductive heating in the initial stage of the inductive heating process and then decreases sharply as the load melts and becomes more conductive so that it is consequently inductively heatable. Once the materials are fully molten and even prior to that, the direct inductive heating energy being absorbed by the conductive disk through inductive heating is minimal in comparison to the direct inductive heating energy being absorbed by the material. By contrast, the load material receives essentially no direct inductive heating energy through inductive heating at the beginning of the process when the material is at lower temperatures.

With continued reference to FIG. 10, once the raw material becomes sufficiently hot to conduct electricity, which may be at the time of melting or at some point prior, the direct inductive heating energy absorbed by the load material increases fairly sharply and in substantially inverse relation to the direct inductive heating energy going to the conductive disk as the material melts and becomes more conductive. Once the material is almost fully melted, and after it is fully melted, nearly all of the energy going to inductive heating is being absorbed by the molten load material. In effect then, the conductive disk has nearly "disappeared" to the electromagnetic field of coil 18 in the sense that virtually all of the direct inductive heating energy being absorbed by the load material and the conductive disk in combination, is being absorbed by the load material as opposed to the conductive disk once the material is fully molten or nearly fully molten. This process happens automatically due to the nature of inductive heating whereby the magnetic field tends to be attracted to electrically conductive materials that are closer to the coil.

With further reference to FIG. 10, of the combined direct inductive heating energy being absorbed by the susceptor and by the material susceptible to inductive heating (hereinafter "the combined energy"), the percentage of direct inductive heating energy being absorbed by the susceptor reaches values lower than possible with known induction furnaces. While the percentage of the combined energy being absorbed by the susceptor is initially 100 percent or very close thereto, that percentage drops drastically during the melting process. The percentage of the combined energy absorbed by the susceptor at a given time during the melting process may be as low as 1 (one) percent or even less. However, under certain circumstances, depending on the particular material to be melted and in order to create overall optimal conditions of power consumption, it may not be possible to obtain such a low percentage. Nonetheless, for many practical applications, percentages for the direct inductive heating energy absorbed by the susceptor may at a given time be no more than 5 (five) percent of the combined energy. This is possible in the melting of semiconductor materials, for example. The direct inductive heating energy absorbed by the susceptor easily reaches 30 percent or less of the combined energy at a given time during the melting process. This is less than any known stationary susceptor in the prior art. It is noted that the lower percentages are often only reached once the material in the crucible is fully molten or nearly so.

Figure 11:
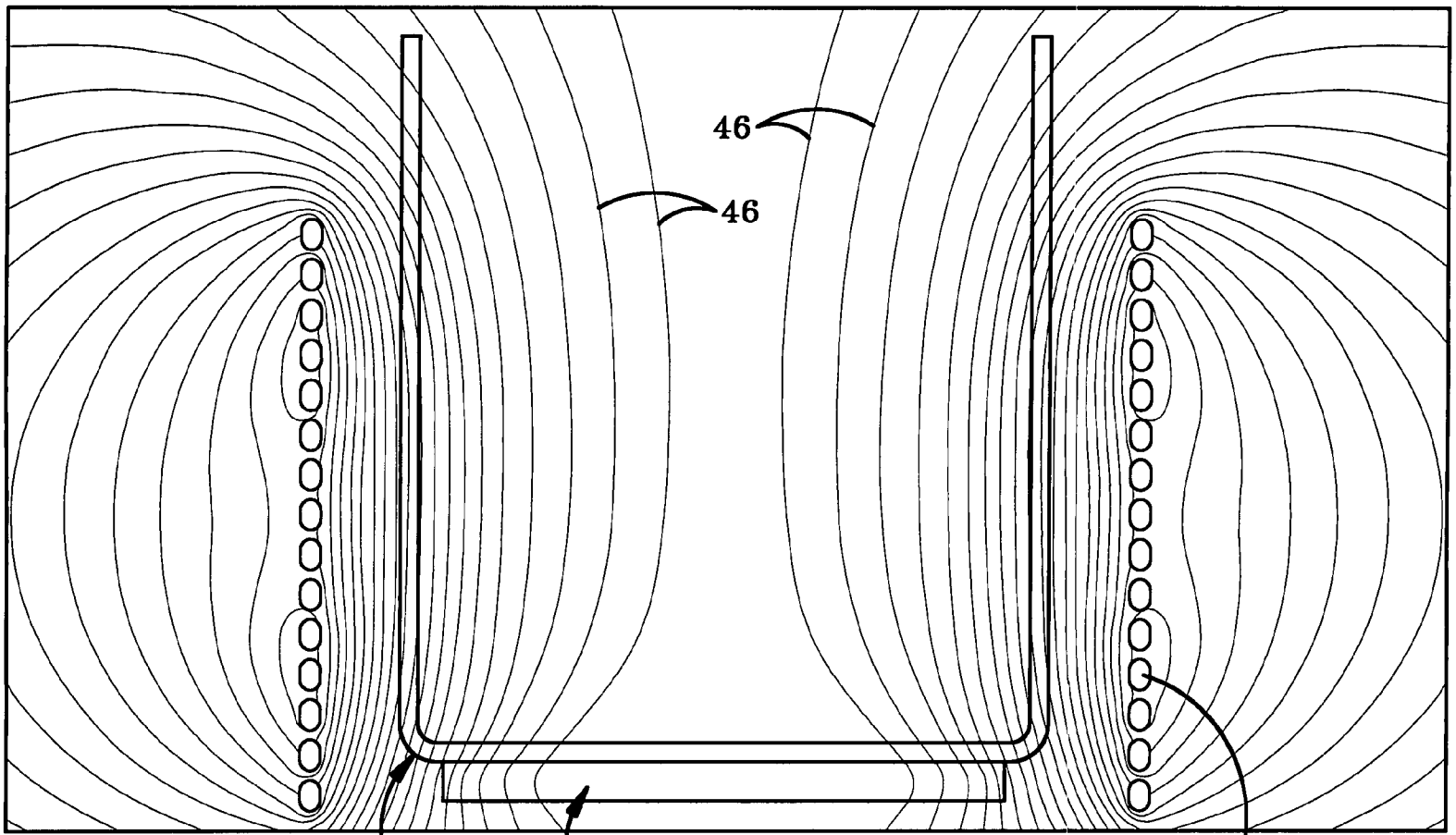
FIG. 11 is a diagrammatic view showing the distribution of the electromagnetic field created by the induction coil with respect to the crucible, the material to be melted therein and the conductive disk at an initial stage.

With reference to FIGS. 11–14, the pattern of the electromagnetic field produced by coil 18 is discussed along with the stirring patterns created within the molten material in crucible 22. With reference to FIG. 11, lines 46 indicate the pattern of the electromagnetic field produced by coil 18. As seen in FIG. 11, lines 46 are bent outwardly from the central portion of crucible 22 in the region of susceptor 24, in accordance with the natural tendency of the electromagnetic field to couple with an electrically conductive material, and particularly with the portion of that material closest to the coil producing the electromagnetic field. At the stage shown in FIG. 11, material 26 within crucible 22 does not affect the electromagnetic field or does so to such a minimal degree that it is not appreciable. At this point, inductive heating produced by coil 18 is for practical purposes within susceptor 24 only.

Figure 12:
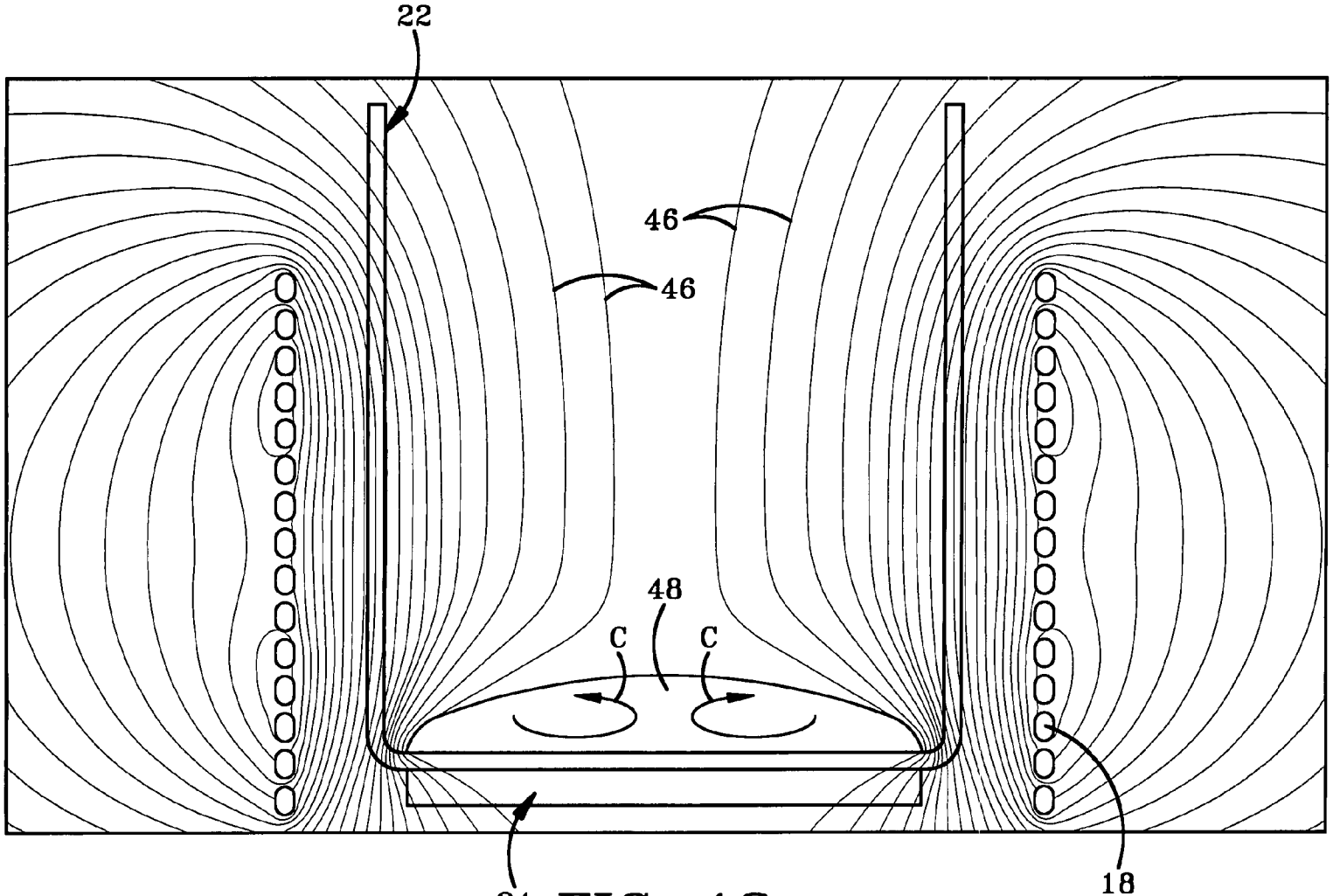
FIG. 12 is similar to FIG. 11 and shows a subsequent stage wherein a portion of the material within the crucible is molten and susceptible to inductive heating.

FIG. 12 shows a further stage of the process wherein a portion of the material has been melted as shown at 48. As clearly seen, lines 46 of the electromagnetic field are moved further outwardly and begin to concentrate on the outer perimeter of molten portion 48 and tend to follow along the upper surface of portion 48 as well. Simultaneously, the amount of energy as represented by lines 46 which passes through susceptor 24, has been reduced. FIG. 12 also shows the early stage of currents indicated by Arrows C, being formed within molten material 48, which are partly due to convection within molten material 48. Electromagnetic forces increasingly affect the stirring patterns, as discussed in further detail hereafter.

Figure 13:
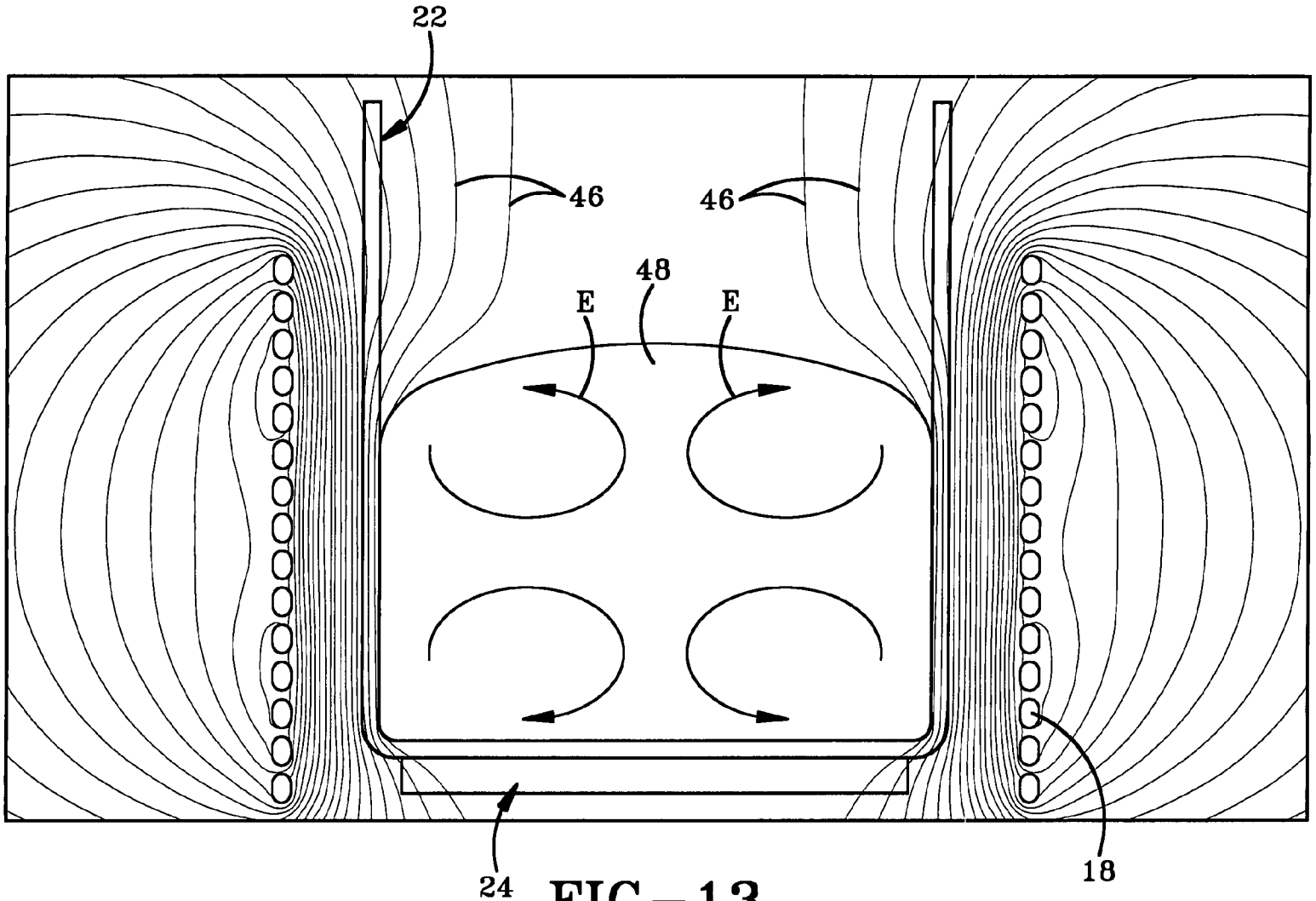
FIG. 13 is similar to FIG. 12 and shows the electromagnetic field distribution when most of the material is molten.

FIG. 13 shows yet a further stage of melting wherein a substantial portion of the material has been melted. Once again, the electromagnetic field as indicated by lines 46, has moved outwardly along the periphery of molten material 48. At this stage, the vast majority of energy used for inductive heating is being absorbed by molten material 48 and a relatively minimal amount is being absorbed by susceptor 24, as indicated by lines 46. In addition, eddy currents within the molten material are further indicated by Arrows E in FIG. 13. As indicated by Arrows E, the current within molten portion 48 is generally divided into an upper portion and a lower portion. In the upper portion, the molten material flows inwardly and upwardly towards the central upper portion of molten portion 48. In the lower portion, the material flows inwardly and downwardly towards the lower central portion of molten portion 48. As noted previously, electromotive forces are primarily responsible for the currents within portion 48, which is further detailed hereafter. The current flow pattern shown in FIG. 13 is known in the art as a "quadrature" flow pattern.

Figure 14:
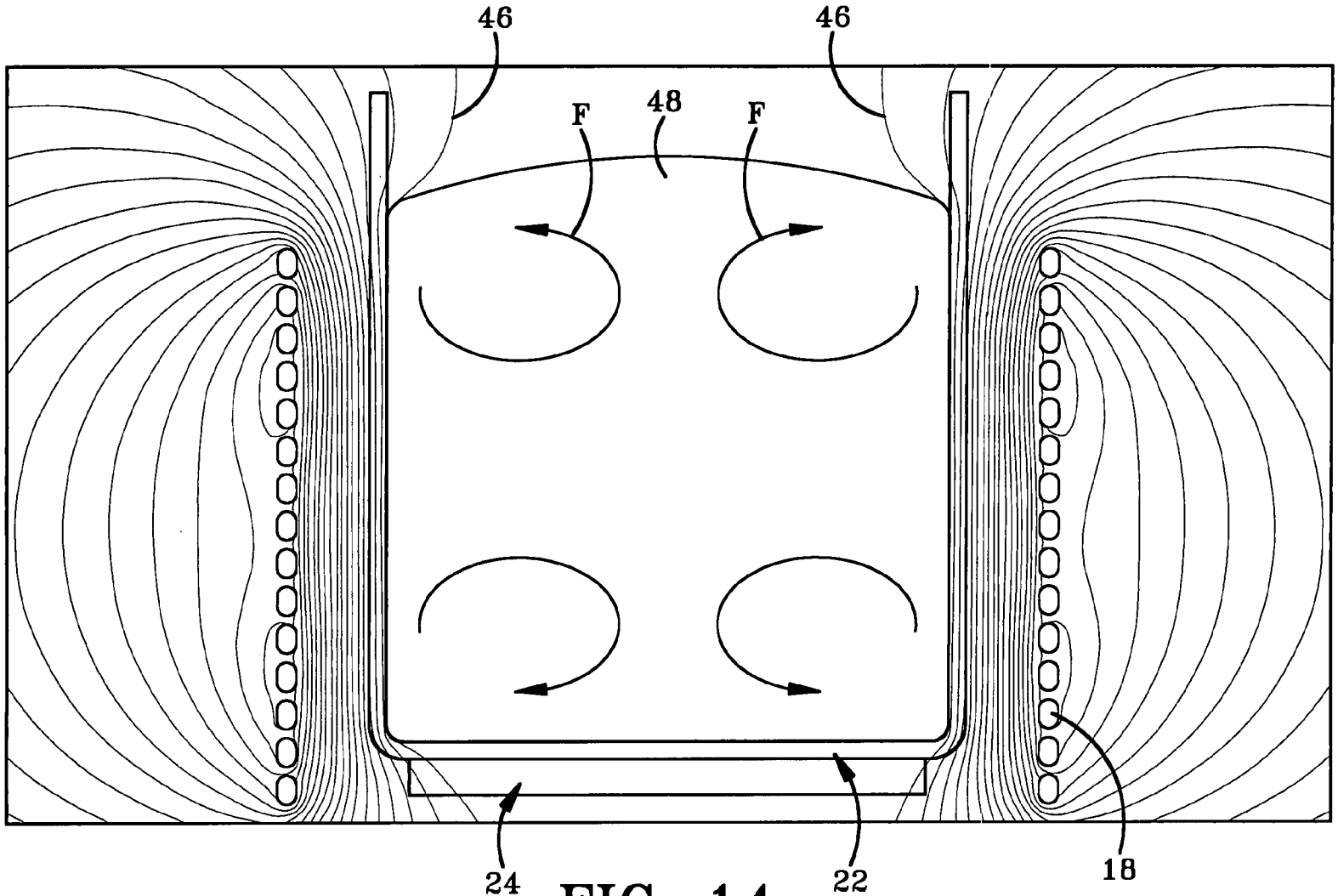
FIG. 14 is similar to FIG. 13 and shows the electromagnetic field distribution when the entire contents of the crucible are molten.

FIG. 14 shows all of the material in crucible 22 in a molten state and further shows the amount of energy being absorbed by susceptor 24 as being minimal and the amount of energy being absorbed by molten material as having substantially increased. FIG. 14 also shows that eddy currents (Arrows F) within the molten material follow the quadrature flow pattern.

Figure 15:
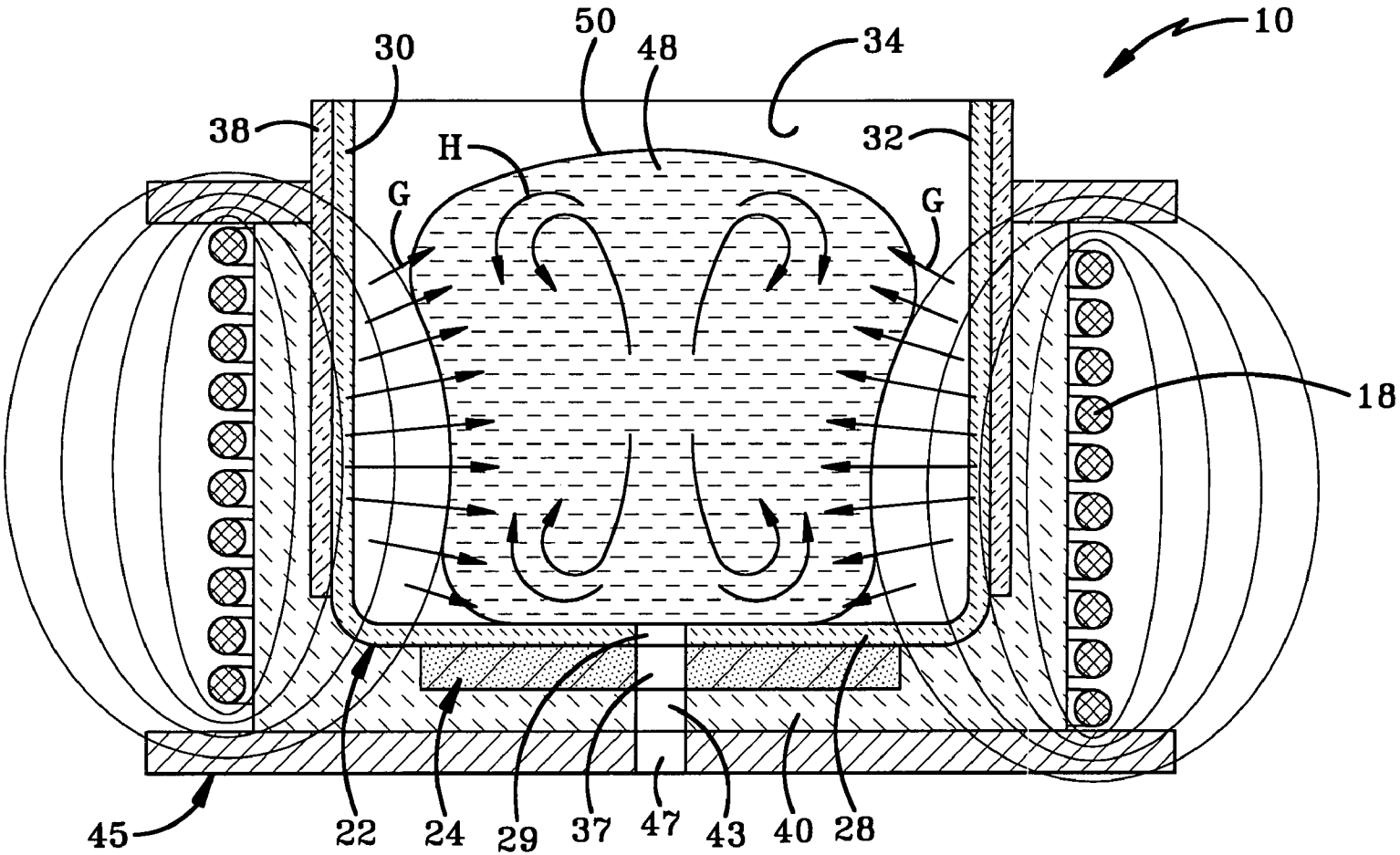
FIG. 15 is a diagrammatic sectional view wherein the entire contents of the crucible are molten and shows the physical effect of the electromotive pinch force and the resulting currents flowing within the molten material.

As noted above, and with reference to FIG. 15, the electromotive forces created by the electromagnetic field of coil 18 push on molten material 48 in the direction of Arrows G. The electromotive forces indicated by Arrows G in the in central region, that is, those that are about halfway up the molten portion 48, exert a stronger force than those toward the top or the bottom portion of molten portion 48. This creates an electromagnetic force pinch effect whereby the molten material is literally moved inwardly away from side wall 30 of crucible 22. In addition, the difference in the strength of the electromagnetic forces as noted, causes the molten material to flow in the directions indicated by Arrows H, that is, in the quadrature pattern discussed above. Convection plays a role in these currents as well. As shown in FIG. 15, the electromotive forces and the currents produced in molten materials 48 create a positive meniscus 50 which can be fairly substantial. While the type currents produced and the positive meniscus described is generally known in the prior art, the increased effect of the electromotive forces on the molten material due to the configuration of susceptor 24, increases the velocity of the flow and the height of the meniscus. The increased velocity helps with the drawing of raw materials into the melt and helps produce a more uniform temperature throughout the melt. In addition, the higher meniscus creates a greater surface area atop the melt, and thereby provides greater opportunity for direct contact between molten material and solid material being added to the melt to expedite the drawing of raw material into the melt.

Figure 16:
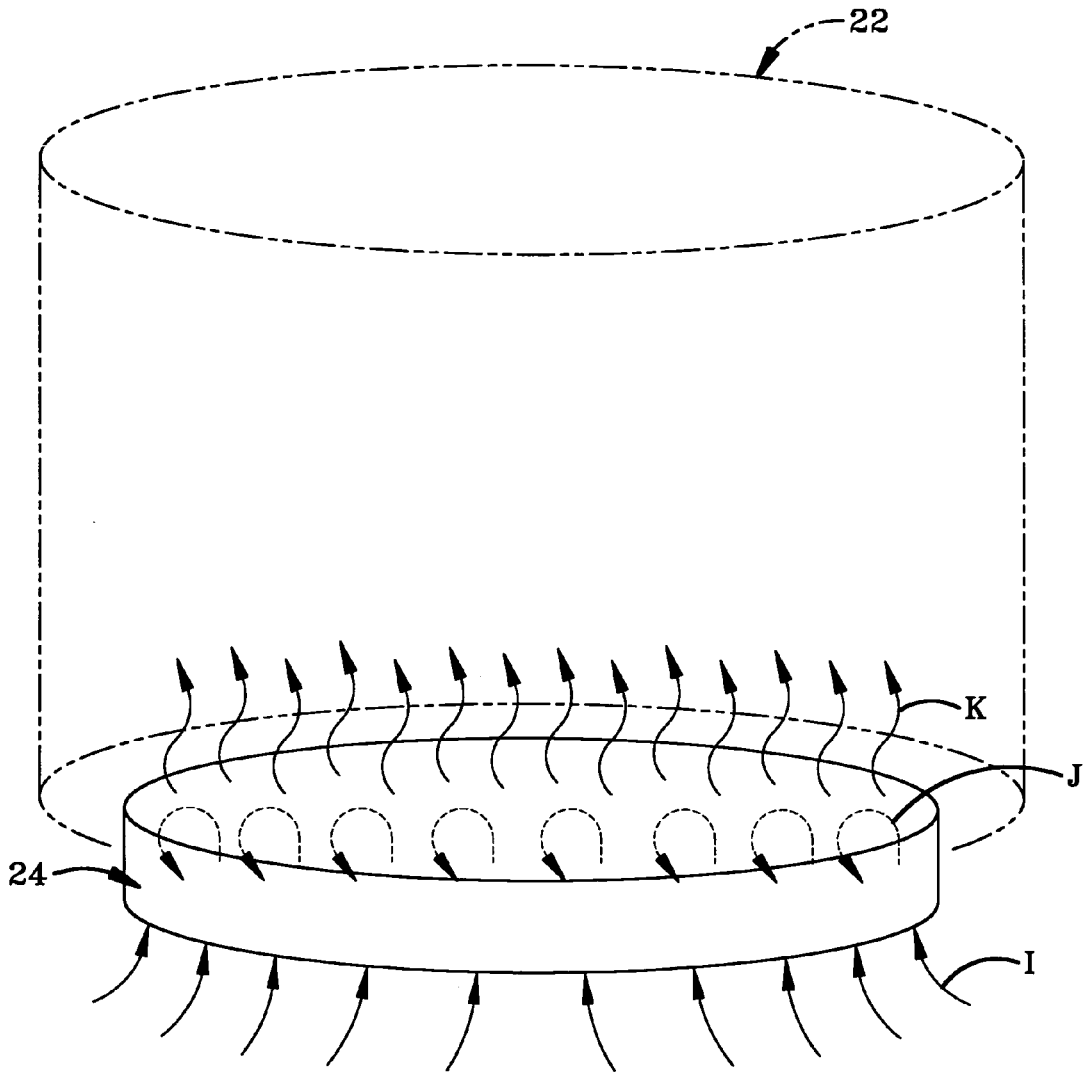
FIG. 16 is a diagrammatic view showing the electromagnetic field creating electrical current within the conductive disk and showing the upward transfer of heat to the crucible through conduction and radiation.

FIG. 16 shows the basic concept of induction heating as well as the transfer of heat from susceptor 24. In particular, Arrows I in FIG. 16 indicate the direction of the electromagnetic field which produces electrical currents shown by Arrows J in accordance with the well-known right-hand-rule regarding inductive currents. As previously discussed, once heat has been inductively produced in susceptor 24, heat is transferred as shown by Arrows K, by conduction and radiation through crucible 22 into materials 26 in order to initially melt the material. Of course, positioning the susceptor beneath the crucible is advantageous in that heat naturally rises.

Furnace 100, the second embodiment of the present invention, is shown in FIG. 17. Furnace 100 is similar to furnace 10 except that susceptor 24 is located inside melting cavity 34 of crucible 22 and is seated on bottom wall 28 thereof, although susceptor 24 may also be disposed upwardly from bottom wall 28 if desired. An optional protective liner 102 encases susceptor 24 to protect against the contamination of the melt by susceptor 24. In addition, refractory material 140 is altered in accordance with the changed location of susceptor 24 and defines a hole 143 through which molten material may flow, as with hole 43 of refractory material 40 of furnace 10.

Furnace 100 operates in the same manner as furnace 10 other than some relatively minor variations. For instance, the configuration of melting cavity 34 is effectively altered by the presence of susceptor 24 therein, which consequently varies the melting pattern somewhat. Where protective liner 102 is used, transferring heat from susceptor 24 to material within melting cavity 34 is hampered to some degree in comparison to using susceptor 24 without liner 102. However, even with liner 102, heat transfer to the material may be more effective in comparison to furnace 10 because heat need not be transferred through bottom wall 28 of crucible 22. In addition, where there is no concern of contaminating the melt with susceptor 24, protective liner 102 may be eliminated and heat transfer from susceptor 24 to the material is then direct. Locating susceptor 24 inside crucible 22 does expose susceptor 24 to higher temperatures due to the inductive heating of the molten material, which may shorten the life of susceptor 24. On the other hand, where susceptor 24 is seated on bottom wall 28, susceptor 24 may insulate bottom wall 28 from the heat from the molten material to some degree, thus adding to the life of the crucible.

A variety of changes may be made to furnaces 10 and 100 without departing from the spirit of the invention. For instance, coil 18 need not be substantially cylindrical in shape in order to properly function. However, the generally cylindrical coil in combination with the cylindrical side wall of crucible 22 and disk shape of susceptor 24, provides an efficient configuration for inductively heating susceptor 24 and material 26 in crucible 22. Further, the induction coil or induction member need not surround the crucible 22 in order for the basic concept of the invention to work. As long as an electromagnetic field is able to inductively heat susceptor 24 and materials 26 within crucible 22, and the induction member is closer to the material to be inductively heated than it is to susceptor 24, the basic process works in accordance with the inventive concept. Thus, the induction member need not be in the form of an induction coil, but may be any member which is capable of producing an electromagnetic field when an electric current passes through it. The illustrated configuration may be more pertinent for certain materials such as semi-conductor materials, which are highly refractory and require a substantial amount of energy to melt.

In addition, susceptor 24 or a similar susceptor may be positioned above the material to be melted. However, contamination of the melt with the susceptor itself may be an issue in certain circumstances. In addition, where there is a desire to prevent contact between the susceptor and the molten material, positioning the susceptor close enough to material to effect sufficient heat transfer becomes an issue. Further, a susceptor extending over a substantial portion of the material may inhibit adding additional material to the crucible. Also, since heat rises, positioning the susceptor above the material to be melted diminishes efficiency of heat transfer.

As noted previously, the susceptor is an electrically conductive material and is preferably graphite, although it may be formed of any suitable material. Further, the susceptor may be of a wide variety of shapes such as, for example, a cylinder, a doughnut, a sphere, a cube, or any particular shape in which an electrical circuit and heat may be formed by induction. Most importantly, the susceptor should be disposed farther from the induction coil than is the susceptible material within the melting cavity. Similarly, the crucible can also take a variety of shapes although the cylindrical shape is preferred as noted above.

Furnaces 10 and 100 show a very simplified bottom flow or bottom pouring concept. This is intended to represent any suitable configuration of a pouring mechanism through which molten material may flow from the crucible, whether a bottom flow, overflow or any other pouring mechanism known in the art.

Induction furnaces 10 and 100 thus provide efficient means for inductively heating materials which are not susceptible to inductive heating at generally lower temperatures and which become inductively heatable at higher temperatures, typically when the material is molten. As discussed earlier, semi-conductor materials, for example, silicon and germanium fall within this group. In addition, this process works well with materials which are normally electrically conductive at lower temperatures but which are in the form of sufficiently small particles whereby electricity will not flow from particle to particle due to the small contact point between adjacent particles. While it is generally desired to use particulate material, furnaces 10 and 100 may also be used to melt or heat larger pieces of material. As noted above, the present invention may also be used with fibrous materials or other materials having geometries which are particularly difficult to melt via inductive heating.

Certain liquids are also particularly suited to heating with the present invention, for example, those liquids which are not susceptible to inductive heating at a relatively lower temperature but which are susceptible to inductive heating at a relatively higher temperature. The invention is also suitable for heating liquids which are susceptible to inductive heating at relatively higher frequencies (i.e., higher frequency electrical current to the induction coil) at a relatively lower temperature and which are susceptible to inductive heating at relatively lower frequencies at a relatively higher temperature due to the corresponding lowered resistivity of the liquid at the higher temperature. This may include scenarios wherein such liquids are simply not inductively heatable at the relatively lower frequency when the liquid is at the relatively lower temperature. This may also include scenarios wherein such liquids are susceptible to inductive heating to some degree at the lower frequency and lower temperature, but only at a relatively lower efficiency, while this efficiency increases at the lower frequency when the temperature of the liquid is sufficiently raised. Thus, the invention is particularly useful in that the conductive member can heat such liquids to bring them into a temperature range where commercially feasible lower frequencies can be used to inductively heat the liquids, substantially increasing the efficiency of heating such liquids.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An induction furnace for melting material, the furnace comprising:

an electrically non-conductive crucible defining a melting cavity;

an electrically conductive member disposed adjacent the crucible in a fixed relation with respect to the crucible;

an induction member for creating an electromagnetic field to inductively heat material within the melting cavity and to inductively heat the conductive member;

each of the conductive member and the material within the melting cavity absorbing energy from the electromagnetic field transferred by direct inductive coupling with the induction member whereby the conductive member and material together absorb a combined energy from the electromagnetic field transferred by said direct inductive coupling;

the crucible, conductive member and induction member being positioned with respect to each other so that inductive heating via the induction member occurs initially within the conductive member and occurs in the material within the melting cavity when the conductive member has transferred sufficient heat to the material to make the material susceptible to inductive heating so that at a certain time during inductive heating the conductive member absorbs no more than thirty percent of the combined energy absorbed by the conductive member and material transferred by said direct inductive coupling.

2. The furnace of claim 1 wherein at the certain time, the conductive member absorbs no more than ten percent of the combined energy.

3. The furnace of claim 1 wherein at the certain time, the conductive member absorbs no more than five percent of the combined energy.

4. The furnace of claim 2 wherein the certain time is when the material is fully molten.

5. The furnace of claim 4 wherein the conductive member is positioned below the crucible and has a substantially cylindrical outer perimeter; and wherein the crucible has a sidewall with an inner diameter and the conductive member outer perimeter defines an outer diameter smaller than the sidewall inner diameter.

6. A method of heating comprising the steps of:

placing material within a melting cavity of an electrically non-conductive crucible;

positioning an electrically conductive member and an induction member so that a portion of the melting cavity is closer to the induction member than is the conductive member, so that no portion of the melting cavity surrounds any portion of the conductive member and so that the electrically conductive member is in a fixed relation with respect to the crucible;

heating the conductive member inductively with the induction member;

transferring heat from the conductive member to the material; and heating a portion of the material inductively with the induction member.

7. The method of claim 6 wherein the step of placing includes the step of placing material which is not initially susceptible to direct inductive heating within the melting cavity; and wherein the step of transferring heat includes making a portion of the material susceptible to inductive heating by the induction member.

8. The method of claim 6 wherein the material is in solid form; and wherein the transferring step includes melting a portion of the material to make the portion susceptible to inductive heating by the induction member.

9. The method of claim 8 further including the step of heating susceptible material inductively until any remaining solid material within the melting cavity is melted.

10. The method of claim 8 wherein the melting step includes heating the material conductively and radiantly with the conductive member.

11. The method of claim 7 further including the step of heating susceptible material inductively until any remaining solid material within the melting cavity is melted.

12. The method of claim 7 wherein the material is in solid form; and further including the step of heating susceptible material inductively to melt a portion of the solid material.

13. The method of claim 11 further including the steps of adding additional solid material to the melting cavity and melting the additional material.

14. The method of claim 13 further including the step of removing molten material from the melting cavity.

15. The method of claim 13 wherein the material is a semi-conductor material and the method further includes the steps of transferring molten material to a receiving crucible and forming a semi-conductor crystal from the molten material in the receiving crucible.

16. The method of claim 15 wherein the step of adding additional solid material and the step of transferring molten material are performed in a manner to allow continuous formation of semi-conductor crystals.

17. The method of claim 15 wherein the step of adding additional solid material and the step of transferring molten material are performed in a manner to allow intermittent formation of semi-conductor crystals.

18. A method of heating comprising the steps of:

placing material within a melting cavity of an electrically non-conductive crucible;

positioning an electrically conductive member and an induction member so that a portion of the melting cavity is closer to the induction member than is the conductive member and so that the electrically conductive member is in a fixed relation with respect to the crucible;

heating the conductive member inductively with the induction member;

transferring heat from the conductive member to the material; wherein the material is electrically non-conductive prior to the step of transferring heat; and heating a portion of the material inductively with the induction member.

19. The furnace of claim 1 wherein at the certain time, the conductive member absorbs no more than twenty percent of the combined energy.

20. The furnace of claim 1 wherein a portion of the melting cavity is closer to the induction member than is the conductive member.

21. The furnace of claim 20 wherein the conductive member has a substantially cylindrical outer perimeter; and wherein the crucible includes a sidewall having a substantially cylindrical inner perimeter which is closer to the induction member than is the conductive member.

22. The furnace of claim 21 wherein the induction member is substantially cylindrical; and wherein the induction member, crucible sidewall inner surface and conductive member outer perimeter are substantially concentric.

23. The furnace of claim 20 wherein the crucible has a bottom and the portion of the melting cavity is adjacent the crucible bottom.

24. The furnace of claim 1 wherein the induction member defines an interior space with a portion of the crucible being disposed within the interior space.

25. The furnace of claim 24 wherein at least a portion of the conductive member is disposed within the interior space.

26. The furnace of claim 1 wherein the conductive member is disposed below the crucible.

27. The furnace of claim 1 wherein the conductive member is substantially disk-shaped.

28. The furnace of claim 1 further including a feed mechanism for adding additional solid material to the melting cavity, a receiving crucible and a transfer mechanism for transferring molten material from the electrically non-conductive crucible into the receiving crucible; and wherein the receiving crucible is adapted for pulling semi-conductor crystals therefrom whereby the furnace is capable of continuous and intermittent semi-conductor crystal formation.

29. The furnace of claim 1 wherein the conductive member is disposed within the melting cavity.

30. The furnace of claim 1 wherein the conductive member includes at least one resistance heating element in electrical communication with an electric power source whereby the at least one heating element is resistively heatable.

31. The furnace of claim 1 wherein during heating and melting of the material the amount of said energy absorbed by the conductive member is substantially inversely proportional to the amount of said energy absorbed by the material in the melting cavity.

32. The method of claim 6 wherein the step of positioning includes the step of positioning the conductive member entirely below a lowermost point of the melting cavity.

33. The method of claim 6 wherein the step of placing includes the step of placing material within the melting cavity which is electrically non-conductive prior to the step of transferring heat to the material.

34. The method of claim 33 wherein the step of transferring heat includes the step of melting the material within the melting cavity; and wherein the material is electrically non-conductive prior to the step of melting.

35. The method of claim 6 wherein the step of placing includes the step of placing material which is not magnetically attractable within the melting cavity.

36. The method of claim 6 wherein the step of placing includes the step of placing nonmetallic material within the melting cavity.

37. The method of claim 6 further including the step of operating an electric power source in electrical communication with the conductive member to resistively heat the conductive member.

38. The method of claim 18 wherein the step of transferring heat includes the step of melting the material within the melting cavity; wherein the material is electrically non-conductive prior to the step of melting.

* * * * *

UNITED STATES PATENT AND TRADEMARK OFFICE

CERTIFICATE OF CORRECTION

PATENT NO. : 7,110,430 B2
APPLICATION NO. : 10/851567
DATED : September 19, 2006
INVENTOR(S) : David A. Lazor It is certified that error appears in the above-identified patent and that said Letters Patent is hereby corrected as shown below:

Column 13, line 29 claim 4 should depend from claim 3, not claim 2 -- 4. The furnace of claim 3 wherein --.

Signed and Sealed this

Twenty-sixth Day of December, 2006

JON W. DUDAS
*Director of the United States Patent and Trademark Office*